US007447447B2

(12) United States Patent
Haga

(10) Patent No.: US 7,447,447 B2
(45) Date of Patent: Nov. 4, 2008

(54) IMAGE FORMING APPARATUS WITH A DISPLAY SCREEN INFORMATION TRANSMISSION FUNCTION

(75) Inventor: Tatsuyoshi Haga, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 330 days.

(21) Appl. No.: 11/304,968

(22) Filed: Dec. 14, 2005

(65) Prior Publication Data

US 2006/0133841 A1 Jun. 22, 2006

(30) Foreign Application Priority Data

Dec. 22, 2004 (JP) ..... 2004-370707

(51) Int. Cl.
*G03G 15/00* (2006.01)

(52) U.S. Cl. ..... 399/8; 399/81

(58) Field of Classification Search ..... 399/8, 399/9, 81; 358/1.18, 296, 300; 345/2.1, 345/2.2

See application file for complete search history.

(56) References Cited

U.S. PATENT DOCUMENTS

| | | | | |
|---|---|---|---|---|
| 6,825,846 | B2 * | 11/2004 | Mondal | 345/547 |
| 7,167,255 | B1 * | 1/2007 | Mikami et al. | 358/1.15 |
| 2002/0078156 | A1 * | 6/2002 | Choi | 709/206 |
| 2003/0067624 | A1 * | 4/2003 | Anderson et al. | 358/1.15 |
| 2005/0254850 | A1 * | 11/2005 | Bardolatzy et al. | 399/81 |
| 2006/0039037 | A1 * | 2/2006 | Shibata | 358/426.01 |

FOREIGN PATENT DOCUMENTS

| | | | | |
|---|---|---|---|---|
| JP | 05-122424 | | | 5/1993 |
| JP | 09083712 | A | * | 3/1997 |
| JP | 11305978 | A | * | 11/1999 |
| JP | 11309928 | A | * | 11/1999 |
| JP | 2000242579 | A | * | 9/2000 |
| JP | 2000-357072 | A | | 12/2000 |
| JP | 2002-281195 | A | | 9/2002 |
| JP | 2003099234 | A | * | 4/2003 |
| JP | 2003159849 | A | * | 6/2003 |
| KR | 2003073799 | A | * | 9/2003 |

* cited by examiner

*Primary Examiner*—Robert Beatty
(74) *Attorney, Agent, or Firm*—Frishauf, Holtz, Goodman & Chick, P.C.

(57) ABSTRACT

An image forming apparatus is provided which includes an image forming section for forming an image based on image data, a user-interface for accepting inputs from an operator and for displaying a display screen to the operator, a memory for storing the display screen, a communication section for sending information to an external device, and a controller for sending information concerning the display screen to the external device through the communication section.

5 Claims, 8 Drawing Sheets

IMAGE FORMING APPARATUS WITH A DISPLAY SCREEN INFORMATION TRANSMISSION FUNCTION

CROSS REFERENCE TO RELATED APPLICATION

This application is based on Japanese Patent Application No. 2004-370707 filed with Japan Patent Office on Dec. 22, 2004.

BACKGROUND OF THE INVENTION

1. Field of the Invention

The present invention relates to an image forming apparatus, that is, to an image forming apparatus which forms an image on a sheet by, for example, an electro-photographic method.

2. Description of the Related Art

Conventionally, an image forming apparatus, for example, a digital copier is widely known. As an embodiment of this image forming apparatus, an image forming apparatus of an electro-photographic system is known, and in this image forming apparatus, when a ray of light is projected on a photoreceptor layer of a photoreceptor, which is uniformly charged, the image is exposed and a latent image is formed, and when the toner is adhered onto the photoreceptor layer on which the latent image is formed, the image is developed, and when this is transferred onto the sheet, the image is formed.

Recently, a system in which such an image forming apparatus is connected to the terminal devices through the network and from this terminal devices, the image forming apparatus is remote-controlled, is proposed.

For example, in Tokkaihei No. 5-122424, the system in which the same user interface as the copier is realized on a observing apparatus, and from the observing apparatus, the copier can be remote-controlled, is disclosed.

Further, in Tokkai No. 2000-357072, a circumstance in which other devices connected onto the network are remote-controlled, is disclosed.

Further, in Tokkai No. 2002-281195, it is disclosed that the degree of freedom of the display content of the operation image screen of the remote operation device is improved, and the operation property when the remote device is operated from this remote operation device, is improved.

However, the conventional technologies as written in the above Patent documents, have the following problems. That is, because the device can operated through the network from the remote place, for example, the service center, when the operator who operates the device is on the side of device and directly operates the device, and when the explanation about the operation method is desired, it does not become a help for the operator who is on the side of the device.

SUMMARY OF THE INVENTION

The present invention is attained in view of the above-described background, and in the image forming apparatus connected to the network, the object of the present invention is to use the circumstance connected to the network, and to provide the image forming apparatus in which points for which the operator who directly operates the image forming apparatus, desires to know can be adequately known by a working man in the service center.

To achieve the least one of the above-mentioned objects of the present invention, an image forming apparatus according to a first aspect of the present invention comprises: an image forming section for forming an image based on image data; a user-interface for accepting inputs from an operator and for displaying a display screen to the operator; a memory for storing the display screen; a communication section for sending information to an external device; and a controller for sending information concerning the display screen to the external device through the communication section.

The controller preferably sends the information concerning the display screen to the external device when the user-interface accepts a sending command from the operator.

The controller preferably sends the information concerning the display screen as an attachment of the electronic mail.

Preferably, the user-interface accepts an input of the text message from the operator, and the controller sends the text message with the information concerning the display screen by the electronic mail.

The controller preferably sends the information concerning the display screen in accordance with a file transfer protocol.

The controller preferably transfers data of the display screen stored in the memory in a form of portable network graphics format and sends the transferred data of the display screen to the external device.

BRIEF DESCRIPTION OF DRAWINGS

These and other objects, advantages and features of the invention will become apparent from the following description thereof taken in conjunction with the accompanying drawings in which.

DETAILED DESCRIPTION OF THE PREFERRED EMBODIMENTS

Hereinbelow, typical embodiments of the present invention will be explained with reference to the drawings. It should be noted that the present invention is not limited to the embodiments described below. Definitions of terms described below are given by way of explanation of terms only, and thus the definitions of the terms of the inventions are not limited thereto.

Figure 1:
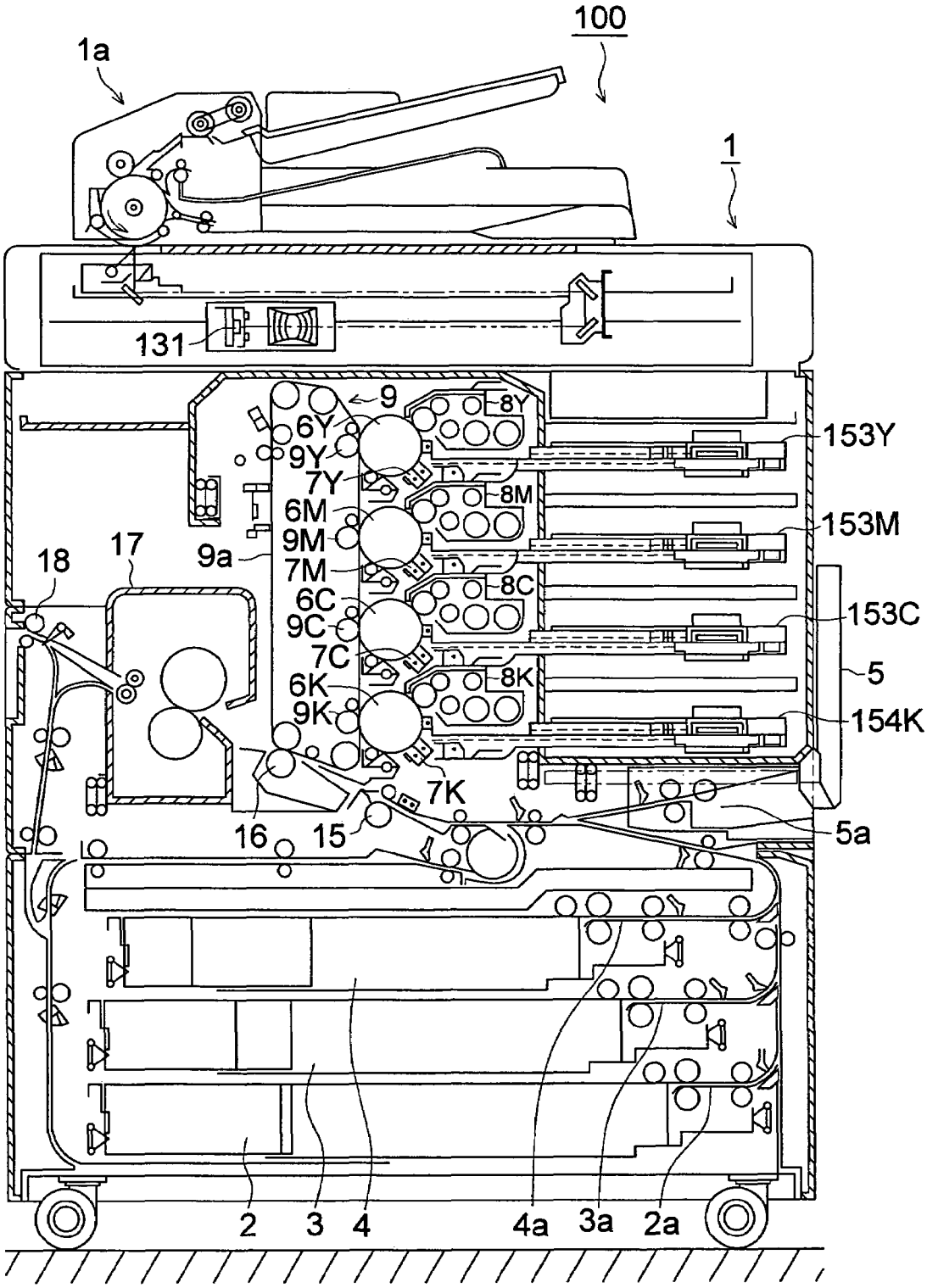
FIG. 1 is a sectional view showing a schematic structure of an embodiment of an image forming apparatus according to the present invention.

FIG. 1 is a sectional view showing a schematic structure of an example of an image forming apparatus according to the present invention. In the present example, as the image forming apparatus, a copier of an electro-photographic system is described as an example, however, it may also be a so-called printer not having an image reading section. Further, in the present example, the image forming apparatus by which the image formation of a color image can be conducted, is described, however, it may also be an image forming apparatus by which only the monochromatic image formation can be conducted.

Initially, a structure and a basic operation of an image forming apparatus 100 will be described. In the image forming apparatus main body 100, a plurality of sets of document writing units 153Y, 153M, 153C are provided for a color image forming section and a document writing unit 154K is provided for a monochromatic image forming section. The document writing units 153Y, 153M, 153C and 153K respectively conduct the document writing (exposing) of a yellow color element, magenta color element, cyan color element, black color element.

Respectively corresponding to the document writing units 153Y, 153M, 153C and 153K, photoreceptors 6Y, 6M, 6C, 6K charging sections 7Y, 7M, 7C, 7K, developing sections 8Y, 8M, 8C, 8K are provided. Further, an intermediate transfer unit 9 common to the color image forming section, monochromatic image forming section, is provided, and this intermediate transfer unit 9 has an intermediate transfer body 9*a*, and primary transfer sections 9Y, 9M, 9C, 9K. The intermediate transfer body 9*a* is an endless belt shape, and wound by a plurality of rollers and rotatably supported. The primary transfer sections 9Y, 9M, 9C, 9K respectively bring the intermediate transfer body 9*a* into contact with photoreceptors 6Y, 6M, 6C, 6K, and transfer images (toner images) formed on these photoreceptors onto the intermediate transfer body 9*a*.

On the upper side of the image forming apparatus 100, a document reading unit 1 which functions as a scanner section, is provided, and by this unit, the document set on a platen of a glass surface is scanned. In the document reading unit 1, a CCD image sensor 131 on which the reflection light obtained by this scanning is incident, is arranged. Hereupon, it is preferable that an ADF (Automatic Document Feeder) 1*a* is connected to the document reading unit 1, and a structure by which both sides of the document can be read, is adopted.

Further, in the lower part of the image forming apparatus 100, sheet feed trays 2, 3, 4 are arranged and each of sheet feed sections 2*a*, 3*a*, 4*a*, is provided to them. Further, on the outer wall part of the side of the image forming apparatus 100, a manual sheet feed tray 5 is provided and a sheet feed section 5*a* for the manual sheet feed tray 5 is provided. In this manner, because a plurality of sheet feed trays and manual sheet feed tray are provided, different sized plurality of kinds of sheets can be used.

On the downstream side of the sheet feed direction of the sheet feed sections 2*a*-5*a*, a register roller 15 is arranged and further on its downstream side, a secondary transfer roller 16 by which the sheet can be pressed onto the intermediate transfer body 9*a*, is arranged. On the downstream side of the secondary transfer roller 16, a fixing section 17 is provided, and on the downstream side of the fixing section 17, a sheet delivery roller 18 is provided.

In the image forming apparatus 100, according to an image forming command, at the time of the printing of the color, each color image formed at need by the document writing units 153Y, 153M, 153C, 154K, the photoreceptors 6Y, 6M, 6C, 6K, charging sections 7Y, 7M, 7C, 7K, developing sections 8Y, 8M, 8C, 8K, is transferred onto the intermediate transfer body 9*a* by the primary transfer sections 9Y, 9M, 9C, 9K. On the one hand, at the time of the monochromatic printing, an image formed by the document writing unit 154K, the photoreceptor 6K, charging section 7K, developing section 8K, is transferred onto the intermediate transfer body 9*a* by the primary transfer section 9K.

On the one hand, the sheet necessary for the image formation is fed from any one of the sheet feed trays 2, 3, 4, or the manual sheet feed tray 5, by the sheet feed sections 2*a*, 3*a*, 4*a*, or 5*a*, and reaches the secondary roller 16 via the register roller 15. The sheet is pressed onto the intermediate transfer body 9*a* by the secondary transfer roller 16, and the image on the intermediate transfer body 9*a* is transferred onto the sheet. In the sheet onto which the image is transferred, the image is fixed in the fixing section, and the sheet is delivered outside the image forming apparatus 100 via the sheet delivery roller 18.

Figure 2:
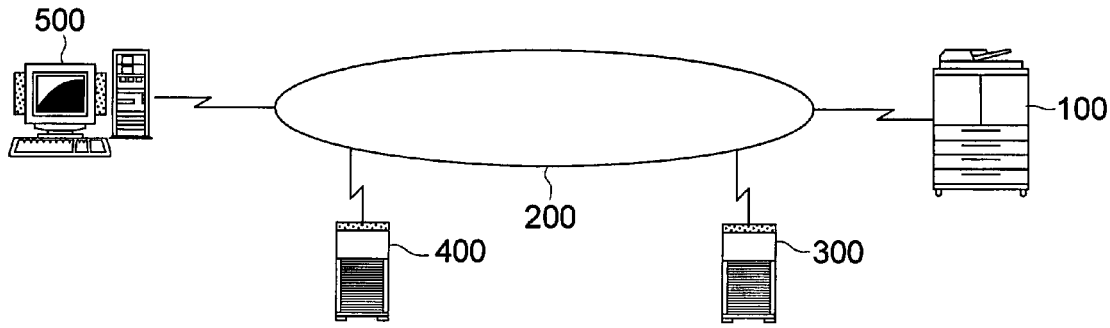
FIG. 2 is a block diagram showing a structural example of a system sending an image displayed on an image screen of a display operation section of the image forming apparatus 100 shown in FIG. 1.

FIG. 2 is a block diagram showing a structural example of a system for sending the image displayed on the image screen of the display operation section of the image forming apparatus 100 shown in FIG. 1.

As shown in FIG. 2, the system of this example, is structured by providing with the image forming apparatus 100, network 200, a mail server 300 for managing an electronic mail sent from the image forming apparatus 100, a mail server 400 for managing the electronic mail sending to the service center, and the terminal device 500 for reading the electronic mail sending to the service center.

As a communication path to whom each device is connected, at least, the image forming apparatus 100 and the mail server 300 are connected, the mail server 300 and the mail server 400 are connected, and the mail server 400 and the terminal device 500 are connected. Further, this communication path, that is, the network 200 may also be structured by only a wire-network, or may also be a network through the aid of a wireless network (for example, wireless LAN (Local Area Network), wireless mobile phone network)) on the way, or may also be structured by only a wireless network.

As the mail server 300 or mail server 400, it is not limited to a desk-top type personal computer or a workstation, but may also use a larger-sized or smaller sized device. Further, as the terminal device 500, other than the personal computer, a PDA (Personal Digital Assistants) or a mobile phone can also be used.

Figure 3:
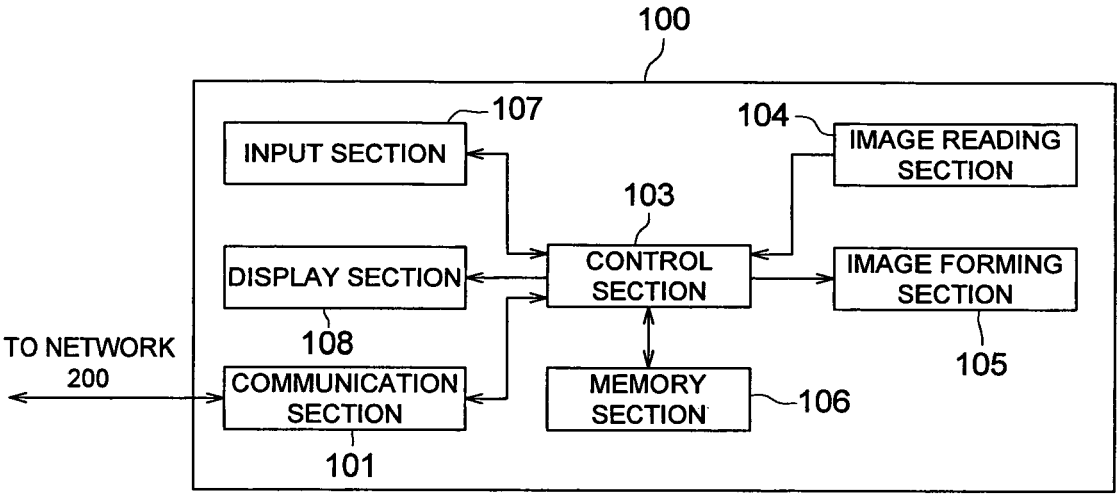
FIG. 3 is a block diagram showing the structure of the image forming apparatus 100 shown in FIG. 1.

FIG. 3 is a block diagram showing a structure of the image forming apparatus 100 shown in FIG. 1. As shown in FIG. 3, the image forming apparatus 100 is structured by providing with a communication section 101 which is an interface with the network 200 shown in FIG. 2, the control section 103 for controlling the operations of the whole image forming apparatus 100, the document reading unit 1, and the image reading section 104 for reading the image from the document, the document writing units 153Y, 153M, 153C, 154K, and the image forming section 105 for forming the image on an image forming sheet, for example, paper, the image data read by the image reading section 104 or other software programs conducted in the control section 103, parameters necessary for the operations of the image forming apparatus 100, the memory section 106 for storing the data for structuring the image data for displaying on the display section 108, the input section 107 for inputting operations, directions to the image forming apparatus 100 of the operator, and the display section 108 for displaying the various information to the operator.

Hereupon, in the present embodiment, a touch-panel image screen 30 (refer to FIG. 4) in which the input section 107 and the display section 108 are integrated with each other, and a display operation section 26 (refer to FIG. 4) having a hard key input section 40 which is a component of the input section 107, are provided.

Further, the control section 103 makes the image data to be displayed on the display section 108 according to the data stored in the memory section 106, developed it in the VRAM (Video Random Access Memory), and the display section 108 displays the image data of this VRAM.

Figure 4:
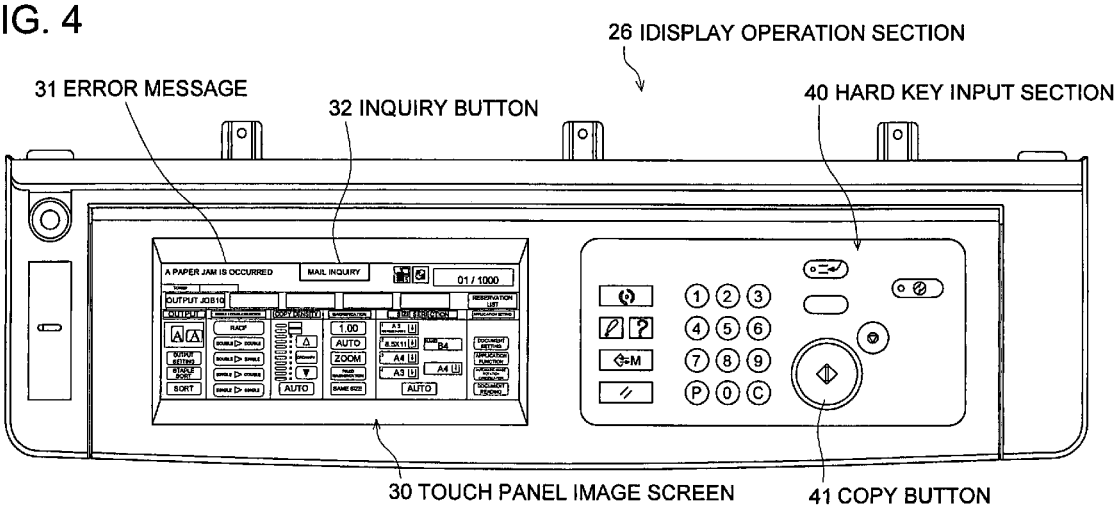
FIG. 4 is a plan view showing an outline of the display operation section of the image forming apparatus 100 shown in FIG. 1.

FIG. 4 is a plan view showing the outline of a display operation section of the image forming apparatus 100 shown in FIG. 1. This display operation section 26 is structured by providing with a touch panel image screen 30 which is a touch panel type operation panel and a hard key input section 40 which is a fixed button type input section such as a pressing button. Hereupon, in the present embodiment, the touch panel image screen 30 is used, however, as the display section 108,it may also be a CRT (Cathode Ray Tube), LCD (Liquid Crystal Display), ELD (Electro Luminescent Display), or a display panel such as an organic EL. This display operation section 26 is not shown in FIG. 1, however, it is preferable that it is provided at a position at which the operator is easily operable.

In this example, as shown in FIG. 4, the touch panel image screen 30 which is used for both the input section 107 and the display section 108 is provided on the left side, and the hard key input section 40 is provided on the right side. Further, in the hard key input section 40, for example, a copy button 41 by which the operator directs the execution of the copy is provided.

Further, on the touch panel image screen 30, an error message 31 which is displayed when the image forming apparatus 100 is in the error status, or an inquiry button 32 used when the operator wants to make an inquiry, for example, to the service center, are displayed. This inquiry button 32 may also allow that it is displayed on each of all image screens displayed on the touch panel image screen 30, or may also allow that it is displayed on only the image screen on which the error massage 31 is displayed.

Figure 5:
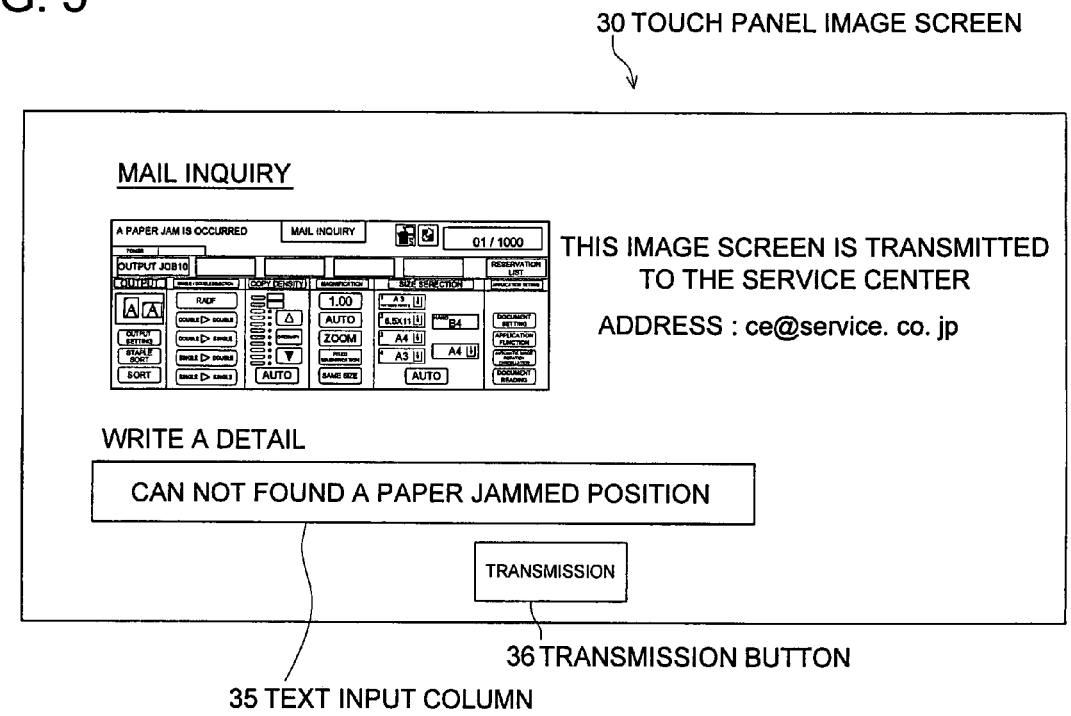
FIG. 5 is a view showing a content displayed on a touch panel image screen 30 when the operator presses an inquiry button 32 displayed on the touch panel 30 of FIG. 4.

FIG. 5 is a view showing the content which is displayed on the touch panel image screen 30 when the operator presses the inquiry button 32 displayed on the touch panel image screen 30 in FIG. 4.

When the operator presses the inquiry button 32 in FIG. 4, the control section 103 receives it, and confirms a comment that sends the image on the image screen, and together with that, as shown in FIG. 5, switches the display content of the touch panel image screen 30 to the image screen which urges the input of the content wanted to inquire in the sentence at the time of that.

The touch panel image screen 30 shown in this FIG. 5 is provided with a text input column 35 into which the operator inputs sentences of inquiry, or a transfer button 36 by which the operator indicates the transfer execution of a mail for inquiry.

Figure 6:
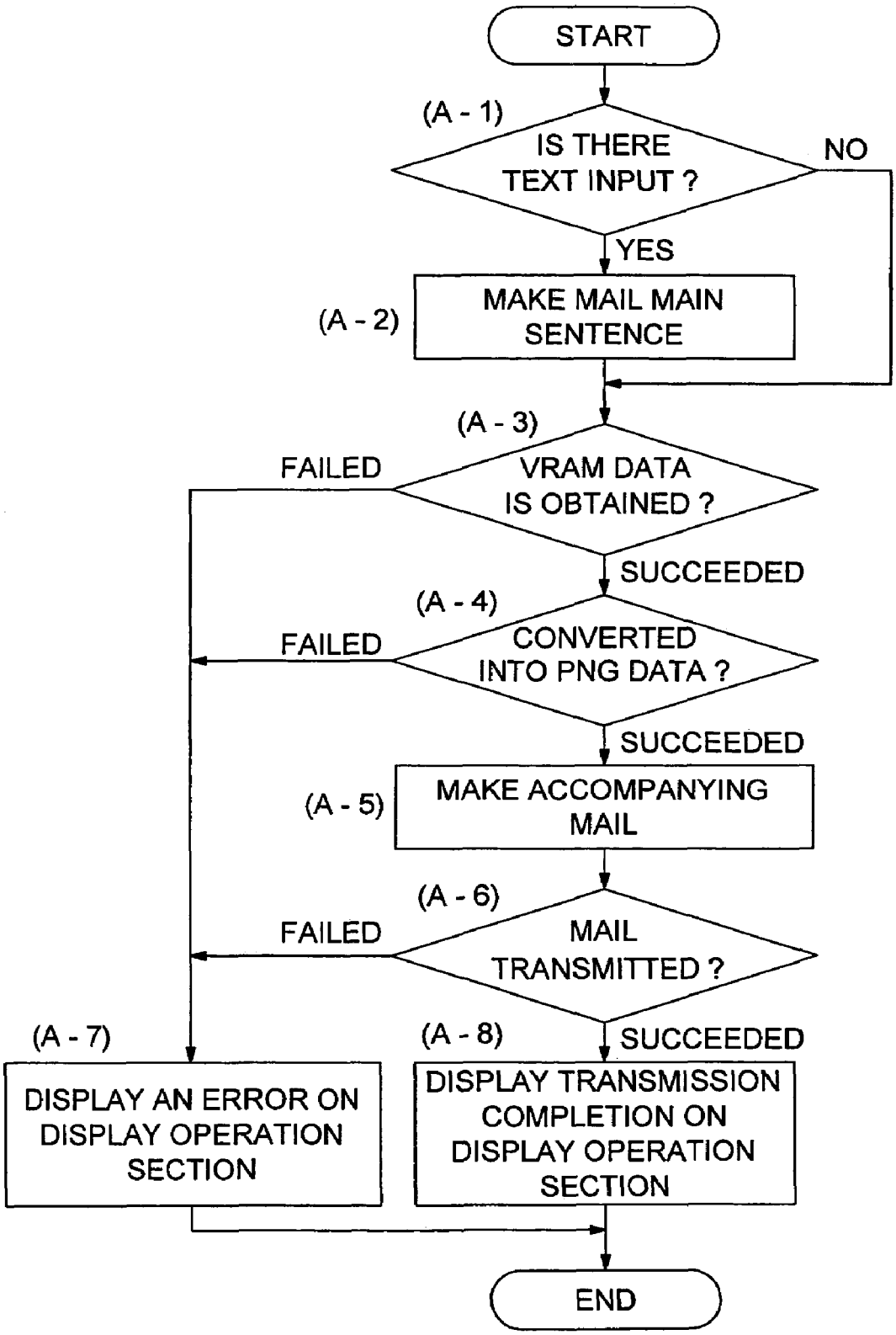
FIG. 6 is a flowchart showing an example of a flow of a processing in which the operator of the image forming apparatus 100 shown in FIG. 1 makes an inquiry to a service center.

Next, referring to the drawings, operations of the present embodiment will be detailed. FIG. 6 is a flow chart showing an example of a flow of the processing in which the operator in the image forming apparatus 100 shown in FIG. 1 inquires to the service center.

In the case where the operator uses the image forming apparatus 100, when the operation is unknown, or there is any point wanted to inquire, the operator presses the inquiry button 32 displayed on the touch panel image screen 30.

The control section 103 received this, switches the display content of the touch panel image screen 30 to the image screen shown in FIG. 5. On this touch panel image screen 30 shown in FIG. 5, the operator inputs a sentence at need into the text input column 35, and after that, presses the transfer button 36. At the time of the character input into the text input column 35, a virtual keyboard having the character arrangement may be displayed on the touch panel image screen 30, and the character input may also be conducted by using it.

When the transfer button 36 is pressed on the touch panel image screen 30, the control section 103 detects it, and executes the processing of FIG. 6.

Initially, the control section 103 judges (A-1) whether the text input is made in the text input column 35 of the touch panel image screen 30 of this time, and when there is a text input, the control section 103 makes the body of a letter of the electronic mail (A-2) based on the inputted sentence.

Next, the control section 103 acquires (A-3) the image data stored in VRAM of the control section 103, that is, the image data of the image screen on which the operator presses the inquiry button 32, and converts the image data into, for example, PNG data (data of PNG (Portable Network Graphics) format)(A-4), and makes the electronic mail (A-5) with an attached file of this PNG data.

Next, the control section 103 transmits (A-6) the electronic mail made in step (A-5), through the communication section 101 and the network 200, to a predetermined mail address in (for example, SMTP (Simple Mail Transfer Protocol). The address may be previously registered in the memory section 106. The transmitted electronic mail is sent to the mail server 400 through the mail server 300 and received by the terminal device. When the mail transfer is successively made, a message that the transmission is completed, is displayed on the touch panel image screen 30 (A-8).

Hereupon, in steps (A-3), (A-4), (A-6), when the transmission is failed by device fault, memory shortage, circuit line down, the message of error is displayed on the touch panel image screen 30 (A-7).

According to the present embodiment, because the image data of VRAM is converted into PNG format, it can be easily read by, for example, the terminal device 500 in the service center.

Figure 7:
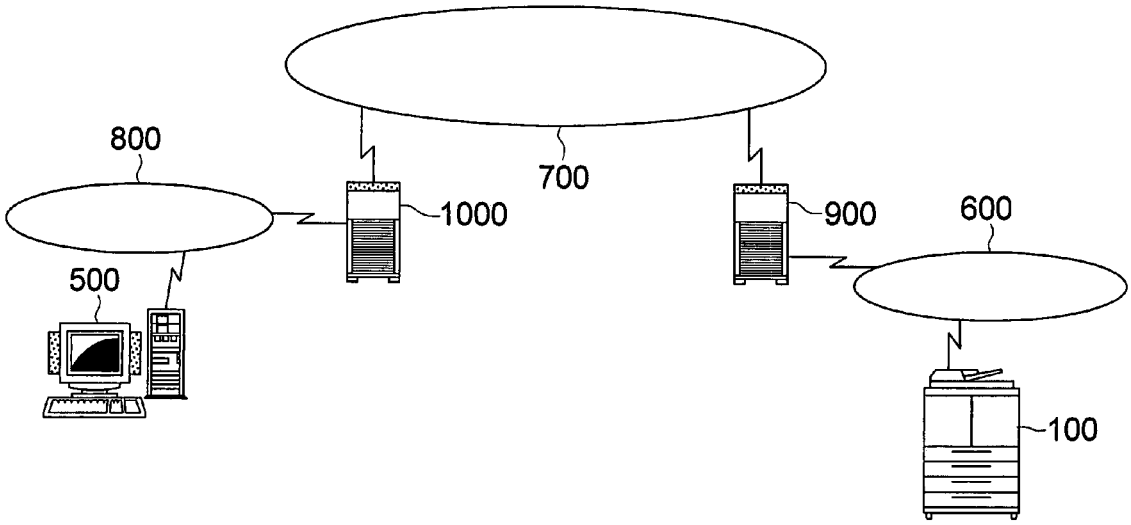
FIG. 7 is a block diagram showing another structural example to FIG. 2 which is the system sending the image displayed on the image screen of the display operation section of the image forming apparatus 100 shown in FIG. 1.

Next, another example of the image forming apparatus according to the present invention will be described. FIG. 7 is a block diagram showing another structural example which is different from FIG. 2 of the system in which the image displayed on the image screen of the display operation section of the image forming apparatus 100 shown in FIG. 1 is transmitted.

In the example shown in FIG. 2, the image data of the image screen is transmitted by being attached to the electronic mail, however, in this example, the image data is transmitted in ftp (File Transfer Protocol).

As shown in FIG. 7, the system of this example is structured by having the image forming apparatus 100, network 600, network 700, network 800, server 900 which structures a firewall between the network 700 and the network 800, ftp server 1000 which receives the file transmitted in ftp from the image forming apparatus 100, and terminal device 500 which reads the file transmitted in ftp to the ftp server 1000.

Also in the communication route in this case, it may also be structured by only the wired network, may also be the network through the wireless network (for example, wireless LAN, wireless mobile phone-use circuit line) in the midway, or may also be a network structured by only the wireless network.

Figure 8:
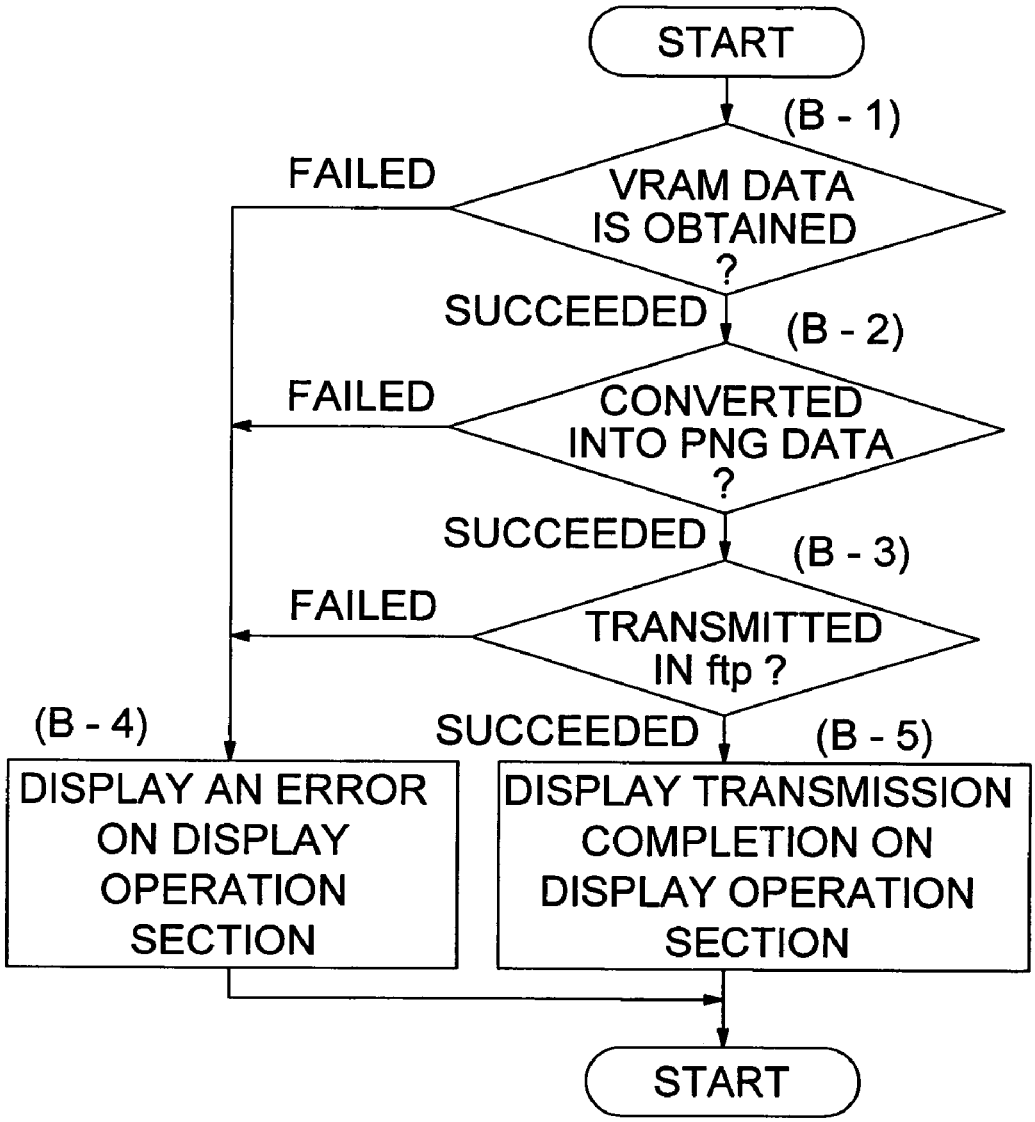
FIG. 8 is a flowchart showing an example of a flow of the processing in which the operator of the image forming apparatus 100 shown in FIG. 1 makes an inquiry to a service center.

FIG. 8 is a flow chart showing an example of a flow of the processing in which the operator in the image forming apparatus 100 shown in FIG. 1 inquires to the service center.

In the case where operator uses the image forming apparatus 100, when the operation is unknown or the operator wants to inquire about any point, the operator presses the inquiry button displayed on the touch panel image screen. In this example of FIG. 8, because only the image data of the image screen is transmitted in ftp, the text input as in the step (A-1) in FIG. 6 is not conducted.

The control section 103 received the pressing of the inquiry button acquires the image data stored in VRAM of the control section 103, that is, the image data of the image screen on which the operator presses the inquiry button (B-1), the image data is converted into for example the PNG data (data of PNG format) (B-2), and transmits the file of this PNG data to the ftp server 1000 (B-3). The address may be previously stored in the memory section 106. The transmitted file is sent to the ftp server 1000 through the server 900, and received by the terminal device 500. When the ftp transmission is succeeded, a message that the transmission is completed is displayed on the touch panel image screen (B-5).

In steps (B-1), (B-2), (B-3), when the transmission is failed by device fault, memory shortage, circuit line down, the message of error is displayed on the touch panel image screen (B-4).

According to this example, because the ftp protocol is used, even in the case where the image forming apparatus is connected to the internal network in which the firewall is provided between the external network and it, the image data of the image screen can be transmitted over the firewall to the addressed ftp server 1000.

Hereupon, in the above example, the format of the image data to be transmitted is PNG, however, the present invention is not limited to this, but any format such as JPEG (Joint Photographic Coding Experts Group) system, GIF (Graphics Interchange Format), TIFF (Tagged Image File Format), PDF (Portable Document Format), BITMAP, furthermore, original format, may also be used. Further, as the communication protocol, other than SMTP, ftp, any protocol such as HTTP (Hyper Text Transfer Protocol), SHTTP (Secure HTTP), furthermore, original protocol, may also be used.

In the above-described 2 examples, in the network-connected image forming apparatus, the network-connected circumstance is used, and an image forming apparatus by which the worker in the service center can adequately know a point wanted to be known by the operator who directly operates the image forming apparatus, can be provided. That is, according to these examples, because the image displayed on the image forming apparatus for the operation guide to the operator can be transmitted through the network, in the service center received the image, the worker can look the same image as the image which is looked by the operator, and can accurately advice to the operator.

Although the present intention has been fully described by way of examples with the reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image forming section for forming an image based on image data;

a user-interface for accepting inputs from an operator and for displaying a display screen to the operator;

a memory for storing the display screen;

a communication section for sending information to an external device; and a controller which, upon receiving an inquiry command from the operator, switches the display screen displayed on the user-interface to an image screen which urges the operator to input an inquiry, and sends information concerning the display screen to the external device through the communication section, wherein the user-interface accepts from the operator an input of a text message as the inquiry relating to the display screen; and wherein the information concerning the display screen sent by the controller includes the text message, and the information is sent to the external device by electronic mail.

2. The image forming apparatus of claim 1, wherein the controller sends the information concerning the display screen to the external device when the user-interface accepts a sending command from the operator.

3. The image forming apparatus of claim 1, wherein the controller sends the information concerning the display screen as an attachment to the electronic mail.

4. The image forming apparatus of claim 1, wherein the controller sends the information concerning the display screen in accordance with a file transfer protocol.

5. The image forming apparatus of claim 1, wherein the controller transfers data of the display screen stored in the memory in portable network graphics (PNG) format to the external device.

* * * * *